US005778865A

United States Patent [19]

Tachibana et al.

[11] Patent Number: 5,778,865

[45] Date of Patent: Jul. 14, 1998

[54] EVAPORATIVE FUEL CONTROL SYSTEM FOR INTERNAL COMBUSTION ENGINES

[75] Inventors: Yosuke Tachibana, Kawauchi-gun; Toru Wada, Utsunomiya; Satoru Kubo, Sioya-gun, all of Japan

[73] Assignee: Honda Giken Kogyo Kabushiki Kaisha, Tokyo, Japan

[21] Appl. No.: 863,815

[22] Filed: May 27, 1997

[30] Foreign Application Priority Data

May 31, 1996 [JP] Japan ..... 8-160942

[51] Int. Cl.[6] ..... F02D 41/00

[52] U.S. Cl. ..... 123/675; 123/519; 123/676

[58] Field of Search ..... 123/675, 520, 123/519, 676, 679

[56] References Cited

U.S. PATENT DOCUMENTS 4,683,861 8/1987 Breitkreuz et al. ..... 123/520

*Primary Examiner*—Raymond A. Nelli

*Attorney, Agent, or Firm*—Frishauf, Holtz, Goodman, Langer & Chick

[57] ABSTRACT

An evaporative fuel control system for an internal combustion engine having a throttle valve includes a canister for adsorbing evaporative fuel generated in the fuel tank, a purging passage for purging evaporative fuel into the intake system of the engine, and a purge control valve for controlling a flow rate of the evaporative fuel to be purged into the intake system through the purging passage. An ECU sets an air-fuel ratio correction coefficient applied in air-fuel ratio feedback control, based on the concentration of a specific component in exhaust gases emitted from the engine, calculates a first learned value of the air-fuel ratio correction coefficient during execution of the air-fuel ratio feedback control, and controls the purge control valve such that the flow rate of the evaporative fuel is changed according to the calculated first learned value. A second learned value of the air-fuel ratio correction coefficient suitable for the transient operating condition of the engine is calculated. When the engine is in a transient operating condition, the first learned value is set to the second learned value.

7 Claims, 9 Drawing Sheets

EVAPORATIVE FUEL CONTROL SYSTEM FOR INTERNAL COMBUSTION ENGINES

BACKGROUND OF THE INVENTION

1. Field of the Invention

This invention relates to an evaporative fuel control system for internal combustion engines, which temporarily stores evaporative fuel generated in the fuel tank, and supplies the evaporative fuel into the intake system of the engine by controlling the amount thereof according to operating conditions of the engine.

2. Prior Art

Conventionally, an evaporative fuel-processing system is provided for internal combustion engines, which temporarily stores evaporative fuel generated in the fuel tank in a canister, and purges the evaporative fuel through a purging passage opening into the intake system of the engine at a location downstream of a throttle valve arranged therein, when the engine is in a predetermined operating condition. With recent diffusion of high-power internal combustion engines, there is a general tendency that evaporative fuel is generated in the fuel tank in increased amounts due to increased heat generation by such a high-power engine. To cope with this, in the conventional evaporative fuel-processing system, the flow rate at which evaporative fuel is to be purged from the canister (purging flow rate) is controlled in response to changes in an air-fuel ratio correction coefficient KO2 during feedback control of the air-fuel ratio of a mixture supplied to the engine, so as to enhance the purging efficiency. Further, it has been proposed to control the purging flow rate, based on an average value of a Lambda correction factor FR for air-fuel ratio feedback control during purging of evaporative fuel, e.g. by U.S. Pat. No. 4,683,861.

According to the above proposed method, however, when the engine is in a transient operating condition where the Lambda correction factor FR largely changes, the average value of the FR value cannot quickly follow the change. As a result, the purging flow rate of evaporative fuel cannot be properly adjusted, resulting in degraded drivability and exhaust emission characteristics of the engine.

SUMMARY OF THE INVENTION

It is the object of the invention to provide an evaporative fuel control system for internal combustion engines, which is capable of properly controlling the purging flow rate of evaporative fuel when the engine is in a transient operating condition, to thereby maintain good drivability and exhaust emission characteristics of the engine.

To attain the above object, according to a first aspect of the present invention, there is provided an evaporative fuel control system for an internal combustion engine having an intake system, a throttle valve arranged in the intake system, and a fuel tank, including a canister for adsorbing evaporative fuel generated in the fuel tank, a purging passage extending between the canister and the intake system, for purging evaporative fuel into the intake system at a location downstream of the throttle valve, a purge control valve for controlling a flow rate of the evaporative fuel to be purged into the intake system through the purging passage, air-fuel ratio correction coefficient-setting means for setting an air-fuel ratio correction coefficient applied in feedback control of an air-fuel ratio of an air-fuel mixture supplied to the intake system, based on concentration of a specific component in exhaust gases emitted from the engine, first calculating means for calculating a first learned value of the air-fuel ratio correction coefficient during execution of the air-fuel ratio feedback control, and control means for controlling the purge control valve such that the flow rate of the evaporative fuel to be purged into the intake system is changed according to the first learned value calculated by the first calculating means.

The evaporative fuel control system according to the first aspect is characterized by an improvement comprising:

transient operating condition-determining means for determining whether the engine is in a transient operating condition;

second calculating means for calculating a second learned value of the air-fuel ratio correction coefficient suitable for the transient operating condition of the engine; and learned value-setting means operable when the transient operating condition-determining means determines that the engine is in the transient operating condition, for setting the first learned value to the second learned value calculated by the second calculating means.

Preferably, the transient operating condition of the engine is an operating condition occurring immediately after the engine has left an idling condition.

More preferably, the second calculating means calculates the second learned value, based on the air-fuel ratio correction coefficient, when the air-fuel ratio feedback control is being executed and at the same time the engine is in the operating condition occurring immediately after the engine has left the idling condition.

Preferably, the learned value-setting means sets the first learned value to the second learned value when the second learned value is smaller than the first learned value.

To attain the object, according to a second aspect of the invention, there is provided an evaporative fuel control system for an internal combustion engine having an intake system, a throttle valve arranged in the intake system, and a fuel tank, including a canister for adsorbing evaporative fuel generated in the fuel tank, a purging passage extending between the canister and the intake system, for purging evaporative fuel into the intake system at a location downstream of the throttle valve, a purge control valve for controlling a flow rate of the evaporative fuel to be purged into the intake system through the purging passage, air-fuel ratio correction coefficient-setting means for setting an air-fuel ratio correction coefficient applied in feedback control of an air-fuel ratio of an air-fuel mixture supplied to the intake system, based on concentration of a specific component in exhaust gases emitted from the engine, average value-calculating means for calculating an average value of the air-fuel ratio correction coefficient during execution of the air-fuel ratio feedback control, learned value-calculating means for calculating a learned value of the air-fuel ratio correction coefficient, based on the average value calculated by the average value-calculating means, and control means for controlling the purge control valve such that the flow rate of the evaporative fuel to be purged into the intake system is changed according to the learned value calculated by the learned value-calculating means.

The air-fuel ratio control system according to the second aspect is characterized by an improvement comprising:

changing means for changing the learned value calculated by the learned value-calculating means, based on a difference between the average value calculated by the average value-calculating means and the learned value calculated by the learned value-calculating means.

Preferably, the changing means changes the learned value by using an updating value, and the updating value is set to a larger value as the difference between the average value calculated by the average value-calculating means and the learned value calculated by the learned value-calculating means increases.

In a preferred embodiment of the invention, there is provided an evaporative fuel control system for an internal combustion engine having an intake system, a throttle valve arranged in the intake system, and a fuel tank, including a canister for adsorbing evaporative fuel generated in the fuel tank, a purging passage extending between the canister and the intake system, for purging evaporative fuel into the intake system at a location downstream of the throttle valve, a purge control valve for controlling a flow rate of the evaporative fuel to be purged into the intake system through the purging passage, air-fuel ratio correction coefficient-setting means for setting an air-fuel ratio correction coefficient applied in feedback control of an air-fuel ratio of an air-fuel mixture supplied to the intake system, based on concentration of a specific component in exhaust gases emitted from the engine, average value-calculating means for calculating an average value of the air-fuel ratio correction coefficient during execution of the air-fuel ratio feedback control, first learned value-calculating means for calculating a first learned value of the air-fuel ratio correction coefficient, based on the average value calculated by the average value-calculating means, and control means for controlling the purge control valve such that the flow rate of the evaporative fuel to be purged into the intake system is changed according to the first learned value calculated by the first learned value-calculating means.

The air-fuel ratio control system according to the preferred embodiment is characterized by an improvement comprising:

- transient operating condition-determining means for determining whether the engine is in a transient operating condition;
- second learned value-calculating means for calculating a second learned value of the air-fuel ratio correction coefficient suitable for the transient operating condition of the engine;
- learned value-setting means operable when the transient operating condition-determining means determines that the engine is in the transient operating condition, for setting the first learned value to the second learned value calculated by the second learned value-calculating means; and
- changing means for changing the first learned value calculated by the first learned value-calculating means, based on a difference between the average value calculated by the average value-calculating means and the first learned value calculated by the first learned value-calculating means.

The above and other objects, features, and advantages of the invention will be more apparent from the following detailed description taken in conjunction with the accompanying drawings.

DETAILED DESCRIPTION

The invention will now be described in detail with reference to the drawings showing an embodiment thereof.

Figure 1:
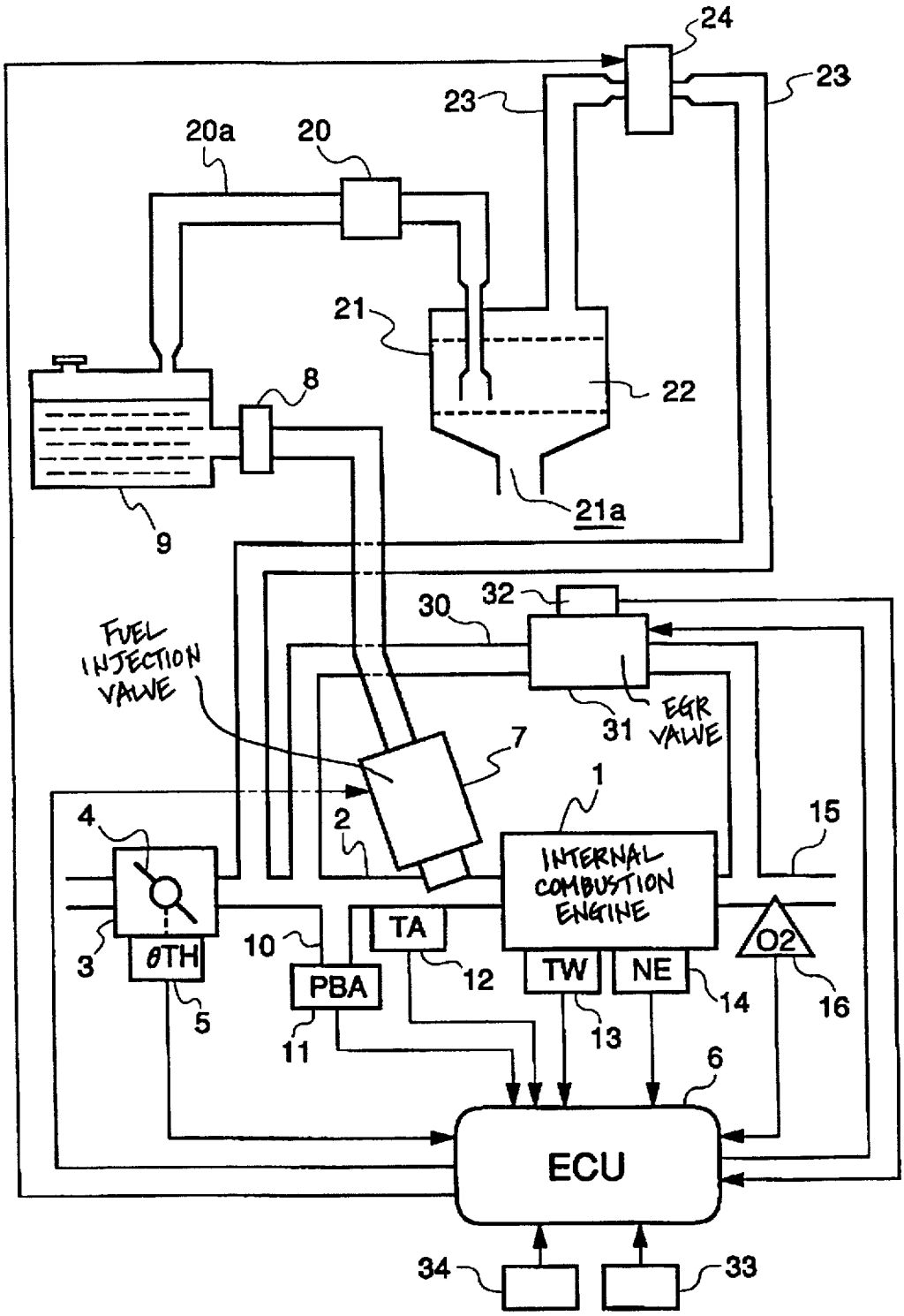
FIG. 1 is a block diagram schematically showing the whole arrangement of an internal combustion engine and an evaporative fuel control system therefor, according to an embodiment of the invention.

Referring first to FIG. 1, there is illustrated the whole arrangement of an internal combustion engine and a control system therefor, including an evaporative fuel control system according to an embodiment of the invention. In the figure, reference numeral 1 designates an internal combustion engine (hereinafter simply referred to as "the engine") having four cylinders, not shown, for instance. Connected to the cylinder block of the engine 1 is an intake pipe 2, across which is arranged a throttle body 3 accommodating a throttle valve 4 therein. A throttle valve opening (θTH) sensor 5 is connected to the throttle valve 4, for generating an electric signal indicative of the sensed throttle valve opening θTH and supplying the same to an electronic control unit (hereinafter referred to as "the ECU") 6.

Fuel injection valves 7, only one of which is shown, are inserted into the interior of the intake pipe 2 at locations intermediate between the cylinder block of the engine 1 and the throttle valve 4 and slightly upstream of respective intake valves, not shown. The fuel injection valves 7 are connected to a fuel tank 9 via a fuel pump 8. The fuel injection valves 7 are electrically connected to the ECU 6 to have their valve opening periods controlled by signals therefrom.

An intake pipe absolute pressure (PBA) sensor 11 is inserted into the intake pipe 2 at a location immediately downstream of the throttle valve 4 via a conduit 10, for supplying an electric signal indicative of the sensed intake pipe absolute pressure PBA to the ECU 6.

Further, an intake air temperature (TA) sensor 12 is arranged in the intake pipe 2 at a location downstream of the PBA sensor 11, for supplying an electric signal indicative of the sensed intake air temperature TA to the ECU 6. An engine coolant temperature (TW) sensor 13 formed of a thermistor or the like is inserted into a coolant passage formed in the cylinder block, for supplying an electric signal indicative of the sensed engine coolant temperature TW to the ECU 6.

An engine rotational speed (NE) sensor 14 is arranged in facing relation to a camshaft or a crankshaft of the engine 1, neither of which is shown. The NE sensor 14 generates a signal pulse as a TDC signal pulse at each of predetermined crank angles whenever the crankshaft rotates through 180 degrees, the TDC signal pulse being supplied to the ECU 6.

An O2 sensor 16 as an exhaust gas component concentration sensor is arranged in an exhaust pipe 15 of the engine 1, for detecting the concentration of oxygen present in exhaust gases emitted from the engine 1, and generating a signal indicative of the sensed oxygen concentration to the ECU 6. Further electrically connected to the ECU 6 are an atmospheric pressure sensor 33 for detecting the atmospheric pressure PA, and a voltage sensor 34 for detecting output voltage VB from a battery for supplying electric power to the ECU 6, a purge control valve 24, etc., of which respective output signals indicative of the sensed parameter values are supplied to the ECU 6.

The fuel tank 9 which is hermetically sealed has an upper internal space thereof connected to the canister 21 via a passage 20*a*. The canister 21 communicates with the intake pipe 2 at a location downstream of the throttle valve 4, via a purging passage 23. The canister 21 accommodates therein an adsorbent 22 for adsorbing evaporative fuel generated in the fuel tank 9, and has an air inlet port 21*a*. Arranged across the passage 20*a* is a two-way valve 20 consisting of a positive pressure valve and a negative pressure valve. Further, arranged across the purging passage 23 is a purge control valve 24 which is a duty ratio-controlled type electromagnetic valve. The purge control valve 24 has a solenoid thereof electrically connected to the ECU 6 to have a valve-opening period (valve-opening duty ratio) thereof controlled by a signal therefrom. The passage 20*a*, the two-way valve 20, the canister 21, the purging passage 23, and the purge control valve 24 collectively form an evaporative emission control system.

The evaporative emission control system operates such that evaporative fuel generated in the fuel tank 9 forcibly opens the positive pressure valve of the two-way valve 20 when the pressure thereof has reached a predetermined value, and then flows into the canister 21 to be adsorbed by the adsorbent 22 and stored in the canister 21. The purge control valve 24 is opened and closed in response to a duty ratio control signal from the ECU 6. While the valve 24 is open, evaporative fuel temporarily stored in the canister 21 is drawn through the purge control valve 24 into the intake pipe 2 together with fresh air introduced through the air inlet port 21*a* of the canister 21, due to negative pressure prevailing in the intake pipe 2, and then delivered to the cylinders. On the other hand, if negative pressure within the fuel tank 9 increases as the fuel tank 9 is cooled by fresh air, etc., the negative pressure valve of the two-way valve 20 is opened and hence evaporative fuel temporarily stored in the canister 21 is returned to the fuel tank 9. Thus, evaporative fuel generated in the fuel tank 9 is prevented from being emitted into the atmosphere.

An exhaust gas recirculation passage 30 extends from the intake pipe 2 at a location downstream of the throttle valve 4 to the exhaust pipe 15, across which is arranged an exhaust gas recirculation control (EGR) valve 31 for controlling an amount of exhaust gases to be recirculated.

The EGR valve 31 is an electromagnetic valve having a solenoid which is electrically connected to the ECU 6 to have its valve opening controlled by a signal from the ECU 6. The EGR valve 31 is provided with a lift sensor 32 for detecting the opening of the EGR valve 31 and supplying an electric signal indicative of the sensed opening value to the ECU 6.

The ECU 6 determines operating conditions of the engine 1, based on engine operating parameter signals from various sensors including ones mentioned above, and supplies a control signal to the solenoid of the EGR valve 31 such that the difference between a valve opening command value LCMD for the EGR valve 31 and an actual valve opening LACT of the EGR valve 31 detected by the lift sensor 32 becomes zero. The valve opening command value LCMD is determined based on the intake pipe absolute pressure PBA and the engine rotational speed NE.

The ECU 6 is comprised of an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), a memory circuit storing operational programs executed by the CPU and for storing results of calculations therefrom, etc., and an output circuit which outputs driving signals to the fuel injection valves 7, the purge control valve 24, and the EGR valve 31, etc.

The CPU of the ECU 6 operates in response to the above-mentioned various engine operating parameter signals from the various sensors to determine operating conditions in which the engine 1 is operating, such as an air-fuel ratio feedback control region where the air-fuel ratio of a mixture supplied to the engine 1 is controlled to a stoichiometric value, in response to an output from the O2 sensor 16, and air-fuel ratio open-loop control regions, and calculates, based upon the determined engine operating conditions, fuel injection periods TOUT of the fuel injection valves 7, a valve-opening duty ratio DOUTPG of the purge control valve 24, and a valve-opening command value LCMD of the EGR valve 31.

Fuel injection from each of the fuel injection valves 7 is carried out in synchronism with generation of TDC signal pulses, and the fuel injection period TOUT is calculated by the use of the following equation (1):

$$TOUT=TI\times KO2\times KPA\times KEGR\times KEVAP\times K1+K2 \quad (1)$$

where TI represents a basic value of the fuel injection period TOUT of the fuel injection valve 7, which is determined according to the engine rotational speed NE and the intake pipe absolute pressure PBA. A TI map for determining the TI value is stored in the memory circuit of the ECU 6

KO2 represents an air-fuel ratio correction coefficient which is determined based on an output value from the O2 sensor 16 when the engine 1 is operating in the air-fuel ratio feedback control region, while it is set to predetermined values corresponding to the respective operating regions of the engine when the engine 1 is in the air-fuel ratio open-loop control regions.

KPA represents an atmospheric pressure-dependent correction coefficient which is set based on the detected atmospheric pressure PA. KEGR represents an EGR-dependent correction coefficient which is set based on the amount of exhaust gases to be recirculated during execution of exhaust gas recirculation.

KEVAP represents an evaporative fuel-dependent correction coefficient which compensates for the influence of purged evaporative fuel, which is set to 1.0 when purging is not effected, while it is set to a value between 0 and 1.0 during execution of purging. As the KEVAP value is smaller, it means that the influence of purging is larger.

K1 and K2 represent other correction coefficients and correction variables, respectively, which are set according to engine operating parameters to such values as optimize engine operating characteristics, such as fuel consumption and engine accelerability.

The CPU of the ECU 6 outputs signals based on results of the calculations mentioned above, for driving the fuel injection valves 7, the purge control valve 24, and the EGR valve 31, via the output circuit of the ECU 6.

Figure 2:
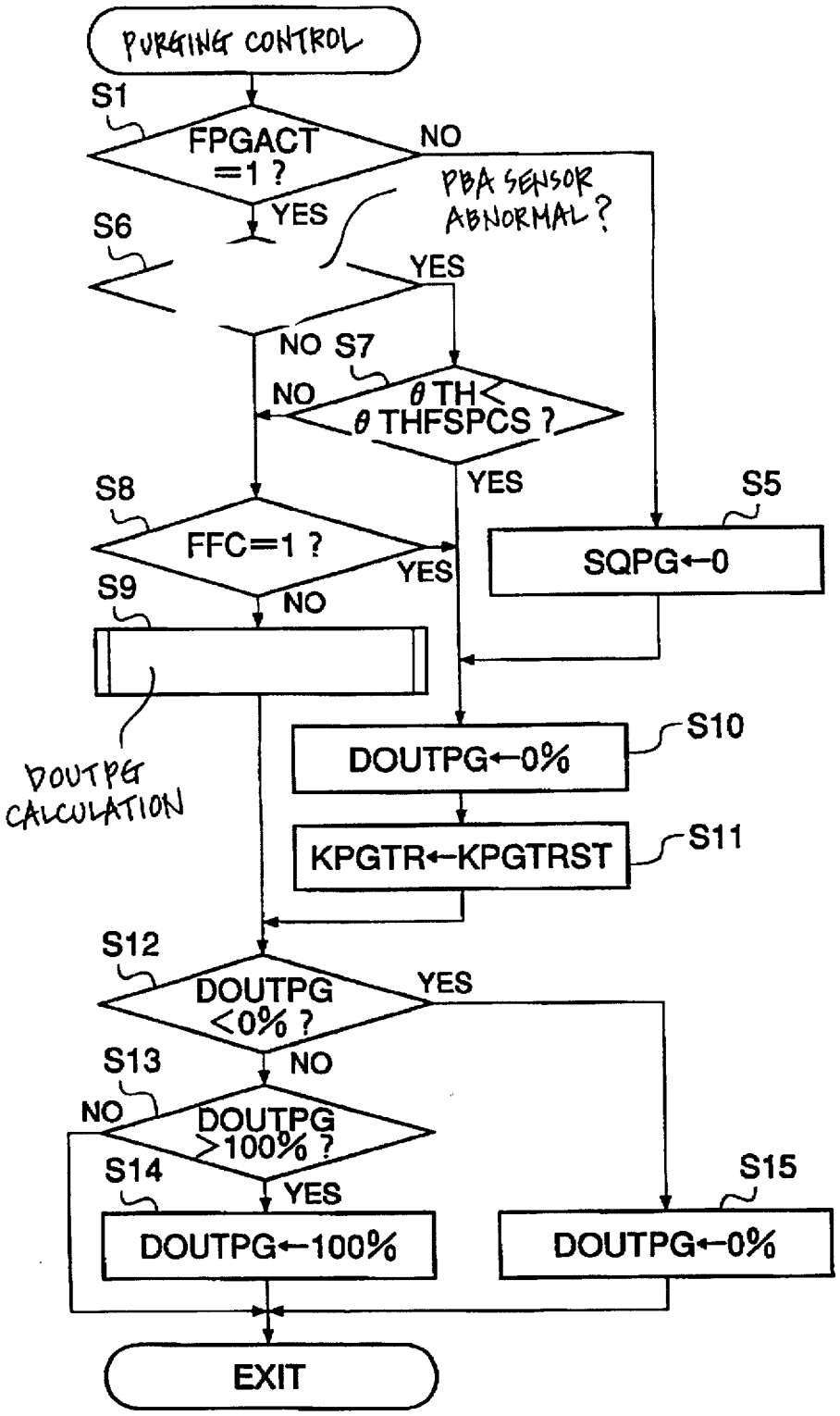
FIG. 2 is a flowchart showing a main routine for carrying out purging control according to the embodiment.

FIG. 2 shows a main routine for calculating the valve-opening duty ratio DOUTPG of the purge control valve 24, which is executed by the CPU of the ECU 6, at predetermined time intervals (e.g. 80 msec).

First, at a step S1, it is determined whether or not a purging permission flag FPGACT which, when set to "1", indicates that execution of purging is permitted, assumes "1". If the purging permission flag FPGACT assumes "0", which means that execution of purging is not permitted, an accumulated or integrated purging flow rate SQPG is set to "0" at a step S5, followed by the program proceeding to a step S10. The integrated purging flow rate SQPG is a parameter calculated by accumulating the flow rate of purged evaporative fuel after the start of purging. More specifically, the SQPG value is determined by a process of FIG. 4, referred to hereinafter.

If the purging permission flag FPGACT assumes "1", which means that execution of purging is permitted at the step S1, it is determined at a step S6 whether or not the PBA sensor 11 is abnormal. If the PBA sensor 11 is not abnormal, the program proceeds to a step S8. On the other hand, if it is abnormal, the program proceeds to a step S7, wherein it is determined whether or not the throttle valve opening θTH is smaller than a predetermined value θTHFSPCS (e.g. 20°). If the throttle valve opening θTH is equal to or larger than the predetermined value θTHFSPCS, the program proceeds to the step S8, whereas if the throttle valve opening θTH is smaller than the predetermined value θTHFSPCS, the program proceeds to a step S10 to inhibit purging.

By virtue of the determinations at the steps S6 and S7, when the PBA sensor 11 is abnormal and at the same time θTH<θTHFSPCS holds, purging is inhibited. As a result, execution of purging in a low load condition of the engine using a value of the throttle valve opening θTH as a substitutive value for the intake pipe absolute pressure PBA can be avoided. Therefore, excessive enrichment of the air-fuel ratio of the mixture can be avoided, to thereby maintain a stable operating condition of the engine.

At the step S8, it is determined whether or not a fuel cut flag FFC which, when set to "1", indicates that fuel cut is being carried out, assumes "1". If the flag FFC assumes "1", i.e. if fuel cut is being carried out, the program proceeds to the step S10 to inhibit purging, whereas if the flag FFC assumes "0", which means that fuel cut is not being carried out, the program proceeds to a step S9.

At the step S10, the valve-opening duty ratio DOUTPG is set to 0%, and a transient condition correction coefficient KPGTR for the purging flow rate is set to an initial value KPGTRST at a step S11, followed by the program proceeding to a step S12.

At the step S9, a DOUTPG-calculating process of FIG. 3, referred to hereinafter, is executed to calculate the valve-opening duty ratio DOUTPG, followed by the program proceeding to the step S12.

At the step S12 to a step S15, limit checking of the valve-opening duty ratio DOUTPG is carried out. More specifically, it is determined at the steps S12 and S13 whether or not the DOUTPG value calculated at the step S9 is smaller than 0% and whether or not it is larger than 100%. If the DOUTPG value is smaller than 0%, the DOUTPG value is set to 0% at the step S14, followed by terminating the routine. On the other hand, if the DOUTPG value is larger than 100%, the DOUTPG value is set to 100% at the step S15, followed by terminating the routine. If the DOUTPG value falls within a range between 0% and 100%, the program is immediately terminated.

Figure 3:
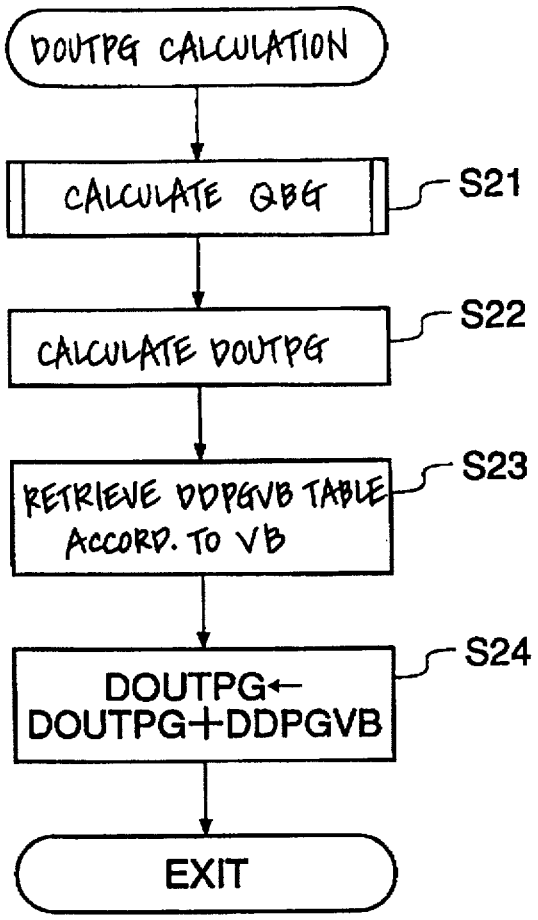
FIG. 3 is a flowchart showing a subroutine for calculating a valve-opening duty ratio of a purge control valve, which is executed at a step S9 in FIG. 2.

FIG. 3 shows a subroutine for calculating the DOUTPG value, which is executed at the step S9 in FIG. 2.

First, at a step S21, a desired flow rate QPG is calculated by the process of FIG. 4, which will be described in detail hereinafter. Then, at a step S22, a DOUTPG table, not shown, is retrieved according to the above calculated desired flow rate QPG, to thereby determine the valve-opening duty ratio DOUTPG. The DOUTPG table is set such that the valve-opening duty ratio DOUTPG is increased as the desired flow rate QPG increases.

At the following step S23, a battery voltage correction term DDPGVB table, not shown, is retrieved according to the battery voltage VB, to determine the battery voltage correction term DDPGVB. The battery voltage correction term DDPGVB table is set such that the battery voltage correction term DDPGVB is decreased as the battery voltage VB increases. Then, at a step S24, the valve-opening duty ratio DOUTPG is corrected by adding the battery voltage correction term DDPGVB to the valve-opening duty ratio DOUTPG calculated at the step S22, followed by terminating the present routine.

Figure 4:
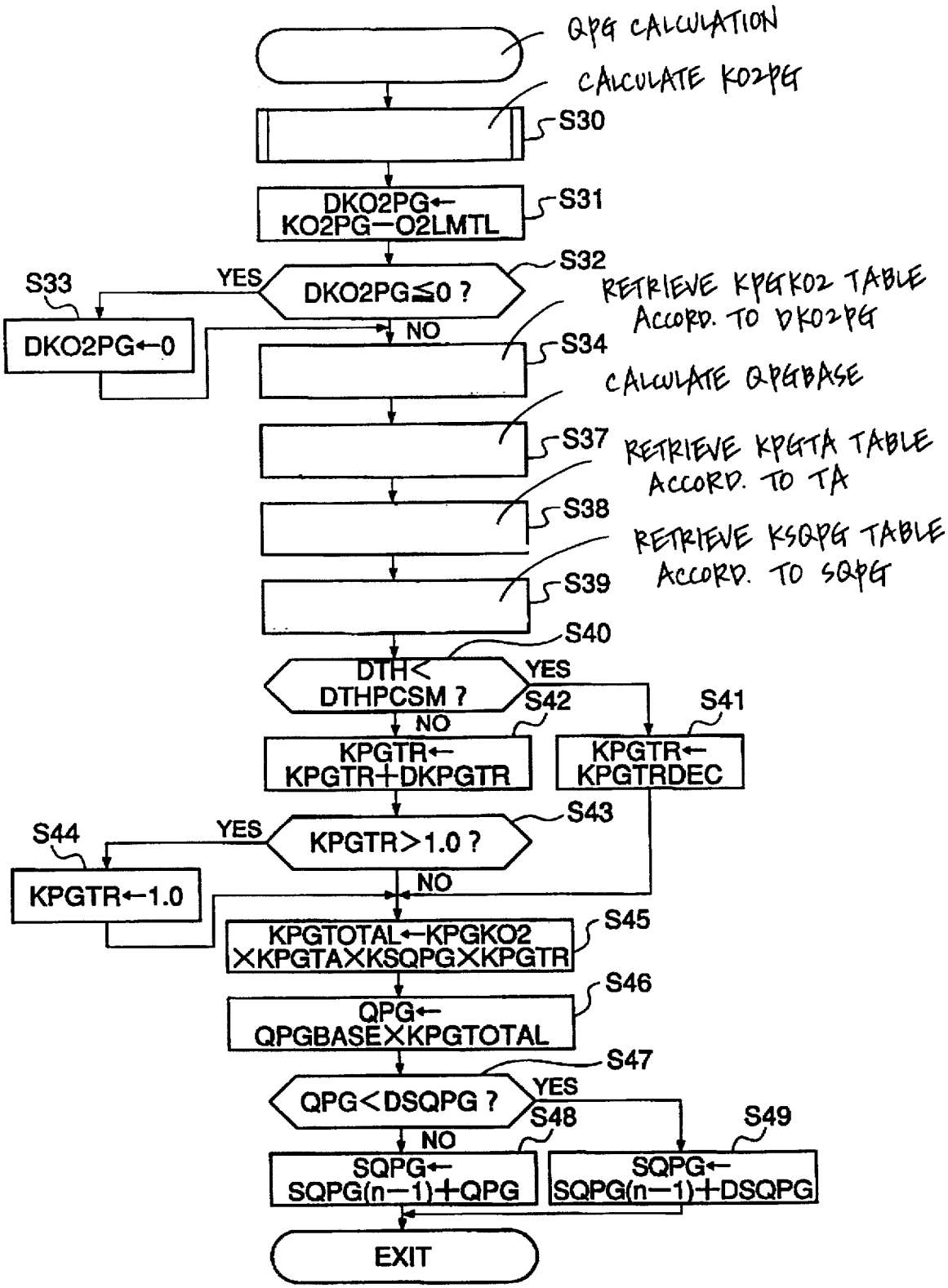
FIG. 4 is a flowchart showing a subroutine for calculating a desired flow rate, which is executed at a step S21 in FIG. 3.

FIG. 4 shows a subroutine for carrying out desired flow rate-calculating process which is executed at the step S21 in FIG. 3.

First, at a step S30, a learned value KO2PG (first learned value) of the air-fuel ratio correction coefficient KO2 which is calculated during execution of the air-fuel ratio feedback control is calculated by a process of FIGS. 6 and 7, hereinafter described.

Then, at a step S31, a difference amount DKO2PG is calculated by the use of the following equation (2):

$$DKO2PG=KO2PG-O2LMTL \quad (2)$$

where O2LMTL represents a predetermined lower limit value of the air-fuel ratio correction coefficient KO2. Accordingly, when the difference amount DKO2PG is small, it means that the KO2 value is close to the lower limit value O2LMTL, i.e. the influence of purging is large.

At the following step S32, it is determined whether or not the difference amount DKO2PG is equal to or smaller than 0. If the answer is affirmative (YES), the DKO2PG value is set to 0 at a step S33, whereas if the answer is negative (NO), the program immediately proceeds to a step S34.

Figure 5:
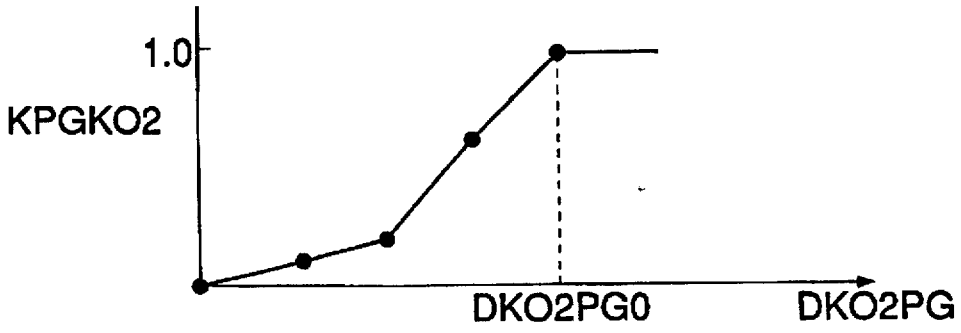
FIG. 5 shows a table for determining a KO2 level correction coefficient KPGKO2.

At the step S34, a KPGKO2 table, shown in FIG. 5, is retrieved according to the difference amount DKO2PG, to determine a KO2 level correction coefficient KPGKO2. The KPGKO2 table is set such that the KPGKO2 value assumes 1.0 when the DKO2PG value is equal to or larger than a predetermined value DKO2PG0, while the KPGKO2 value is set to a smaller value as the DKO2PG value decreases when the DKO2PG value is smaller than the predetermined value DKO2PG0. In other words, when the influence of purging is large, the purging flow rate is decreased as the influence becomes larger.

At a step S37, a basic value of the desired flow rate QPGBASE is calculated by the use of the following equation (3):

$$QPGBASE=KQPG\times TI\times KPA\times KEGR\times NE \quad (3)$$

wherein KQPG represents a predetermined coefficient for converting a fuel amount into a desired flow rate. Therefore, the basic desired flow rate QPGBASE has a value proportionate to the fuel amount supplied to the engine per unit time.

At a step S38, a KPGTA table, not shown, is retrieved according to the intake air temperature TA, to determine an intake air temperature-dependent correction coefficient KPGTA. The KPGTA table is set such that the KPGTA value is decreased as the intake air temperature TA rises. Then, at a step S39, a KSQPG table, not shown, is retrieved according to the integrated purging flow rate SQPG, to determine an integrated flow rate-dependent correction coefficient KSQPG. The KSQPG table is set such that the KSQPG value is increased as the integrated purging flow rate SQPG increases.

At the following step S40, it is determined whether or not a rate of change DTH in the throttle valve opening θTH (=a present value of the θTH value—a last value of the θTH value) is smaller than a predetermined negative value DTHPCSM (e.g. −1.0°). If the rate of change DTH is below the predetermined negative value DTHPCSM, it is determined that the engine is in a transient condition toward a decelerating condition, and therefore the transient condition correction coefficient KPGTR is set to a predetermined value KPGTRDEC smaller than 1.0 (e.g. 0.2) at a step S41, followed by the program proceeding to a step S45.

On the other hand, if the answer to the question of the step S40 is negative (NO), i.e. if the rate of change DTH is equal to or larger than the predetermined negative value DTHPCSM, a predetermined addend term DKPGTR is added to the transient condition correction coefficient KPGTR to increase the same at a step S42, and then it is determined at a step S43 whether or not the KPGTR value exceeds 1.0. If the KPGTR value exceeds 1.0, the KPGTR value is set to 1.0 at a step S44, followed by the program proceeding to the step S45. On the other hand, if the KPGTR value is equal to or smaller than 1.0, the program skips the step S44 to the step S45.

At the step S45, a total correction coefficient KPGTOTAL for the basic desired flow rate QPGBASE is calculated by applying the above determined correction coefficients, by the use of the following equation (4):

$$KPGTOTAL=KPGKO2\times KPGTA\times KSQPG\times KPGTR \quad (4)$$

Then, the basic desired flow rate QPGBASE is multiplied by the thus calculated total correction coefficient KPGTOTAL to calculate the desired flow rate QPG at a step S46, and it is determined at a step S47 whether or not the thus calculated desired flow rate QPG is smaller than a predetermined value DSQPG. If the desired flow rate QPG is equal to or larger than the predetermine value DSQPG, the integrated purging flow rate SQPG is calculated by the use of the following equation (5), followed by terminating the present routine. On the other hand, if the desired flow rate QPG is below the predetermine value DSQPG, the integrated purging flow rate SQPG is calculated by the use of the following equation (6), followed by terminating the present routine:

$$SQPG=SQPG(n-1)+QPG \quad (5)$$

$$SQPG=SQPG(n-1)+DSQPG \quad (6)$$

where (n−1) indicates that the SQPG value is a last value, and the predetermined value DSQPG is a value (e.g. 1 liter/min) corresponding to a least significant bit (LSB) for the calculation of the integrated purging flow rate SQPG.

As described hereinabove, according to the present embodiment, if it is determined that the engine 1 is in a transient condition toward a decelerating condition, the transient condition correction coefficient KPGTR is set to the small predetermined value KPGTRDEC (e.g. 0.2) at the steps S40 and S41, and therefore the desired flow rate QPG is decreased. As a result, the air-fuel ratio of the mixture can be prevented from being excessively enriched upon entering the decelerating condition, to thereby maintain good exhaust emission characteristics. On the other hand, if it is determined at the step S40 that the engine is not in a transient condition just before a decelerating condition, the desired flow rate QPG is progressively increased at the steps S42 and S44, and therefore sharp fluctuations in the air-fuel ratio can be prevented.

Figure 6:
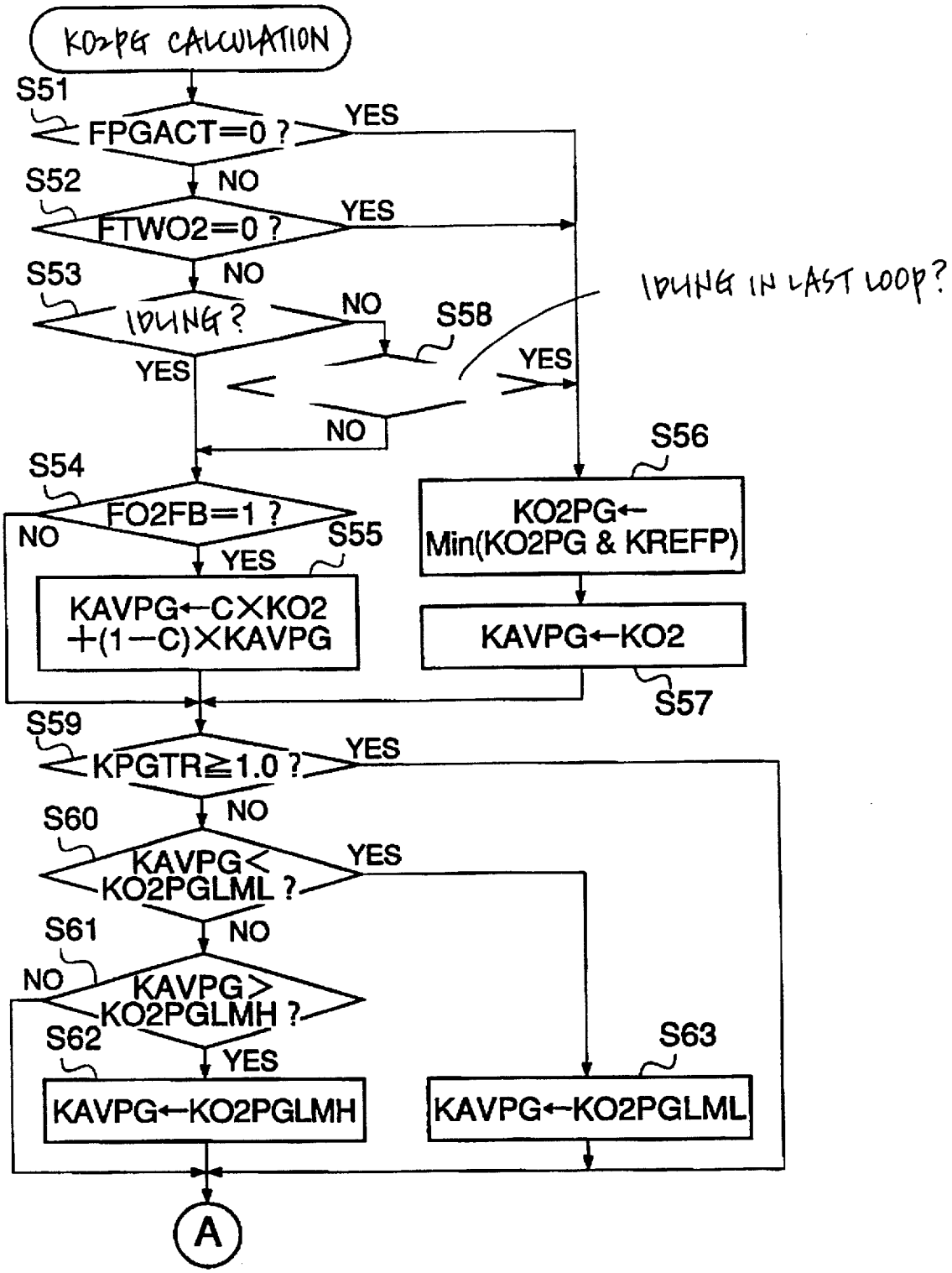
FIG. 6 is a flowchart showing a subroutine for calculating a learned value KO2PG of an air-fuel ratio correction coefficient KO2, which is executed at a step S30 in FIG. 4.
Figure 7:
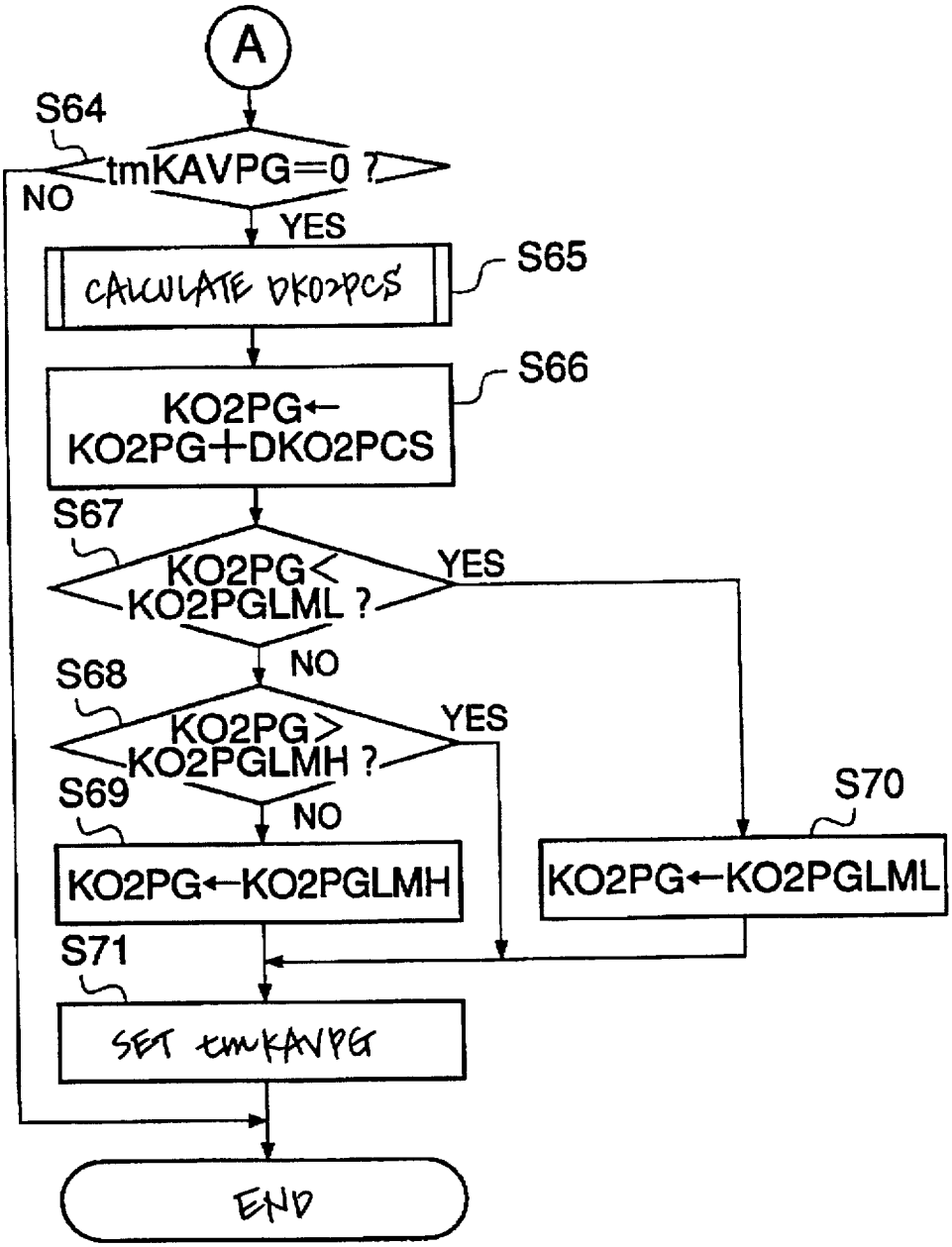
FIG. 7 is a continued part of the flowchart of FIG. 6.

FIGS. 6 and 7 show a subroutine for calculating the learned value KO2PG of the air-fuel ratio correction coefficient KO2, which is executed at the step S30 in FIG. 4. This routine is executed by the CPU of the ECU 6 at predetermined time intervals (e.g. 10 msec).

First, at a step S51, it is determined whether or not the purging permission flag FPGACT assumes "0". If the purging permission flag FPGACT assumes "1", i.e. if purging is being carried out, the program proceeds to a step S52, wherein it is determined whether or not a flag FTWO2 assumes "0". The flag FTWO2, when set to "0", indicates that the engine coolant temperature TW is lower than a predetermined value (e.g. 50° C.). If the flag assumes "1", i.e. if the engine coolant temperature TW is higher than the predetermined value, it is determined at a step S53 whether or not the engine 1 is idling. If the engine is idling at the step S53, it is determined at a step S54 whether or not a flag FO2FB which, when set to "1", indicates that the air-fuel ratio feedback control is being carried out, assumes "1". If the answer is affirmative (YES), i.e. if the air-fuel ratio feedback control is being carried out, then at a step S55, an average value KAVPG of the air-fuel ratio correction coefficient KO2 is calculated by the use of the following equation (7), followed by the program proceeding to a step S59:

$$KAVPG=C\times KO2+(1-C)\times KAVPG \quad (7)$$

where C represents a constant value set between 0 and 1, KO2 a value of the KO2 value assumed when a proportional term has been applied to the KO2 value (immediately after inversion of the output from the O2 sensor) during execution of the air-fuel ratio feedback control, and KAVPG on the right side a last value of the KAVPG value.

If it is determined at the step S53 that the engine I is not idling, the program proceeds to a step S58, wherein it is determined whether or not the engine 1 was idling in the last loop of execution of the routine. If the answer is negative (NO), it is determined that the engine 1 is in a steady operating condition where the engine rotational speed NE is equal to or larger than a predetermined value, or in a transient operating condition, and then the program proceeds to the steps S54 and S55.

Figure 9:
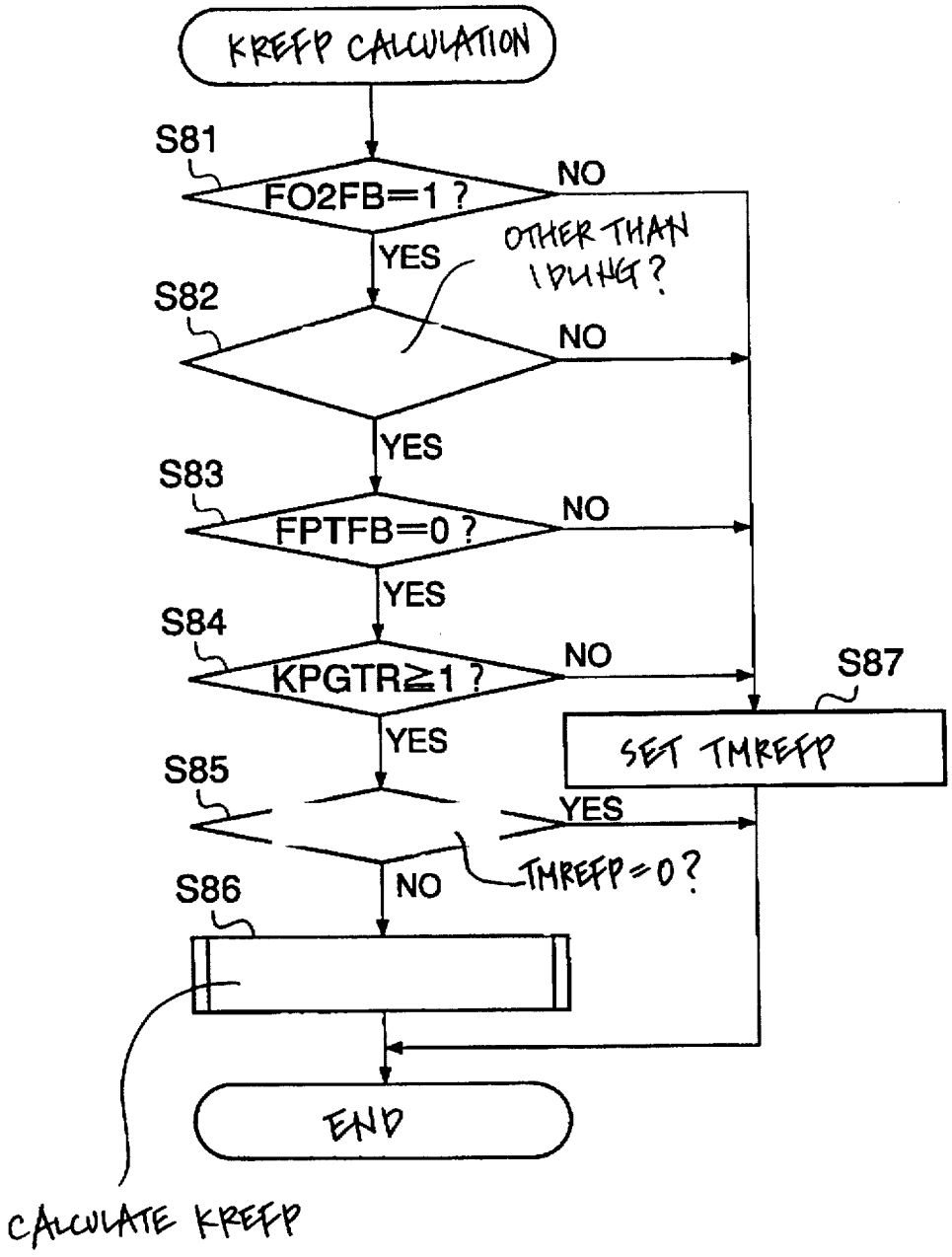
FIG. 9 is a flowchart showing a subroutine for calculating a second average value KREFP of the air-fuel ratio correction coefficient KO2 during a transient operating condition of the engine.

On the other hand, if the flag FPGACT assumes "0" at the step S51, i.e. if purging is not being carried out, if the flag FTWO2 assumes "0" at the step S52, i.e. if the engine coolant temperature TW is lower than the predetermined value, or if the engine 1 was idling in the last loop and is not idling in the present loop at the step S58, the learned value KO2PG is calculated by the use of the following equation (8):

$$KO2PG=Min(KO2PG\ \&\ KREFP) \quad (8)$$

where KREFP represents a second average value (second learned value) of the air-fuel ratio correction coefficient KO2 applied when the engine 1 is in a transient operating condition, which is calculated at the step S56, by a process shown in FIG. 9. The right side of the equation (8) indicates that the smaller value of the last value of the learned value KO2PG and the second average value KREFP is selected as a present value of the learned value KO2PG. That is, if the second average value KREFP is smaller than the last value of the learned value KO2PG, the KREFP value is selected as the the present value of the learned value KO2PG.

At a step S57, the average value KAVPG is set to the air-fuel ratio correction coefficient KO2, and the program proceeds to the step S59.

At the step S59, it is determined whether or not the transient condition correction coefficient KPGTR is equal to or larger than 1.0. If the transient condition correction coefficient KPGTR is below 1.0, limit checking of the average value KAVPG is executed at steps S60 to S63. More specifically, it is determined at the steps S60 and S61 whether or not the average value KAVPG calculated at the step S55 or S57 is smaller than a lower limit value KO2PGLML or larger than an upper limit value KO2PGLMH. If the average value KAVPG is smaller than the lower limit value KO2PGLML, the former is set to the latter at the step S63, followed by the program proceeding to a step S64. On the other hand, if the average value KAVPG is larger than the upper limit value KO2PGLMH, the former is set to the latter at the step S62, followed by the program proceeding to the step S64. If it is determined at the step S59 that the transient condition correction coefficient KPGTR is larger than 1.0, the program skips over the steps S60 to S63 to the step S64.

Then, it is determined at the step S64 whether or not the value of a timer tmKAVPG which is set to a predetermined time period (e.g. 2 sec) at a step S71 in FIG. 7, referred to hereinafter, is equal to 0. If the value of the timer tmKAVPG is not equal to 0, it is determined that the predetermined time period has not elapsed, and therefore the program is immediately terminated. On the other hand, if the value of the timer tmKAVPG is equal to 0, it is determined that the predetermined time period has elapsed, and then an updating amount DKO2PCS table shown in FIG. 8 is retrieved according to a difference (KAVPG−KO2PG) between the average value KAVPG and the last value of the learned value KO2PG, to determine the updating amount DKO2PCS.

In the updating amount DKO2PCS table, if the difference (KAVPG−KO2PG) is equal to or smaller than a predetermined negative value V1, the updating amount DKO2PCS assumes a negative constant value DKO2PCS1, while if the difference (KAVPG−KO2PG) is equal to or larger than a predetermined positive value V2, the updating amount DKO2PCS assumes a positive constant value DKO2PCS2. If the difference (KAVPG−KO2PG) falls within a range between the predetermined negative value V1 and the predetermined positive value V2, the updating amount DKO2PCS is set to a larger value as the difference (KAVPG−KO2PG) increases.

Figure 8:
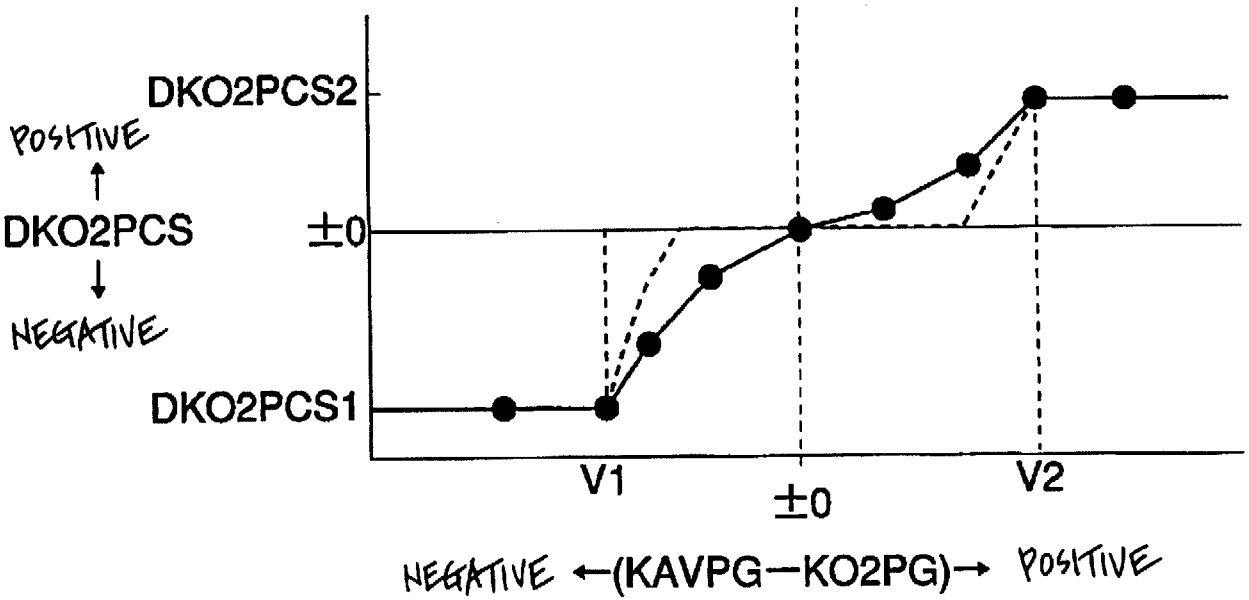
FIG. 8 shows a table for determining an updating amount DKO2PCS according to a difference between an average value KAVPG of the air-fuel ratio correction coefficient KO2 and the learned value KO2PG.

Alternatively, in the updating amount DKO2PCS table of FIG. 8, a dead zone may be provided in the vicinity of a point where the difference (KAVPG−KO2PG) assumes ±0, as indicated by the broken line, such that the updating amount DKO2PCS is equal to ±0 in the zone irrespective of the difference (KAVPG−KO2PG).

Referring again to FIG. 7, at a step S66, the learned value KO2PG is calculated by the use of the following equation (9):

$$KO2PG=KO2PG+DKO2PCS \quad (9)$$

where DKO2PCS represents the updating amount calculated at the step S65, and KO2PG on the right side a last value of the learned value KO2PG.

At the following steps S67 to S70, limit checking of the learned value KO2PG is executed. More specifically, it is determined at the steps S67 and s68 whether or not the learned value KO2PG calculated at the step S66 is smaller than the lower limit value KO2PGLML or larger than the upper limit value KO2PGLMH. If the learned value KO2PG is smaller than the lower limit value KO2PGLML, the former is set to the latter at the step S70, followed by the program proceeding to the step S71. On the other hand, if the learned value KO2PG is larger than the upper limit value KO2PGLMH, the former is set to the latter at the step S69, followed by the program proceeding to the step S71. Then, the timer tmKAVPG is set to the predetermined time period at the step S71, followed by terminating the present routine. The timer tmKAVPG is provided in order to execute the process of the step S65 to S70 once a predetermined time period to thereby reduce the frequency of execution of the same.

FIG. 9 shows a subroutine for calculating the second average value KREFP of the air-fuel ratio correction coefficient KO2 calculated and applied in the transient operating condition of the engine 1 at the step S56 in FIG. 6. This subroutine is executed at the step S56 in FIG. 6.

First, it is determined at a step S81 whether or not the flag FO2FB assumes "1", which means that the air-fuel ratio feedback control is being carried out, and it is determined at a step S82 whether or not the engine 1 is in an operating condition other than idling. Then, it is determined at a step S83 whether or not the flag FPFB assumes "0", which means that air-fuel ratio feedback control in which the air-fuel ratio is controlled to a rich value is not being carried out, and it is determined at a step S84 whether or not the transient condition correction coefficient KPGTR is equal to or larger than 1. If any of the answers to the questions of the steps S81 to S85 is negative (NO), the program proceeds to a step S87, wherein a timer TMREFP is set to a predetermined time period (e.g. 15 sec), followed by terminating the present routine.

On the other hand, if the answers to the questions of the steps S81 to S84 are all affirmative (YES), the program proceeds to a step S85, wherein it is determined whether or not the value of the timer TMREFP which has been set to the predetermined time period at the step S87 is equal to 0. While the timer TMREFP is counting the predetermined time period, the program proceeds to a step S86, wherein the second average value KREFP of the air-fuel ratio correction coefficient KO2 for the transient operating condition of the engine 1 is calculated, by the use of the following equation (10):

$$KREFP=C\times KO2+(1-C)\times KREFP \quad (10)$$

where C represents a constant value set between 0 to 1, and KREFP on the right side a last value of the second average value KREFP.

If it is determined at the step S85 that the count value of the timer TMREFP becomes equal to 0, it is determined that the predetermined time period has elapsed, and then the program is immediately terminated.

According to the present embodiment, as described above, immediately after the engine 1 has left idling (steps S53→S58→S56), it is determined that the engine 1 is in a transient operating condition, and the learned value KO2PG is set to the second average value KREFP suitable for such a transient operating condition of the engine 1 (step S56). Further, the updating amount DKO2PCS is determined based on the difference amount DKO2PG between the average value KAVPG and the last value of the learned value KO2PG (step S65), and the learned value KO2PG is corrected by adding the updating amount DKO2PCS to the last value of the learned value KO2PG (step S66). As a result, where the engine enters a transient operating condition in which the KO2 value largely changes, the learned value KO2PG can quickly follow or respond to the change of the air-fuel ratio correction coefficient KO2. By virtue of this quick response, the purging flow rate can be properly controlled to the desired value in the transient operating condition of the engine 1, to thereby maintain good drivability and exhaust emission characteristics of the engine.

What is claimed is:

1. In an evaporative fuel control system for an internal combustion engine having an intake system, a throttle valve arranged in said intake system, and a fuel tank, including a canister for adsorbing evaporative fuel generated in said fuel tank, a purging passage extending between said canister and said intake system, for purging evaporative fuel into said intake system at a location downstream of said throttle valve, a purge control valve for controlling a flow rate of said evaporative fuel to be purged into said intake system through said purging passage, air-fuel ratio correction coefficient-setting means for setting an air-fuel ratio correction coefficient applied in feedback control of an air-fuel ratio of an air-fuel mixture supplied to said intake system, based on concentration of a specific component in exhaust gases emitted from said engine, first calculating means for calculating a first learned value of said air-fuel ratio correction coefficient during execution of said air-fuel ratio feedback control, and control means for controlling said purge control valve such that said flow rate of said evaporative fuel to be purged into said intake system is changed according to said first learned value calculated by said first calculating means, the improvement comprising:

transient operating condition-determining means for determining whether said engine is in a transient operating condition;

second calculating means for calculating a second learned value of said air-fuel ratio correction coefficient suitable for said transient operating condition of said engine; and learned value-setting means operable when said transient operating condition-determining means determines that said engine is in said transient operating condition, for setting said first learned value to said second learned value calculated by said second calculating means.

2. An evaporative fuel control system as claimed in claim 1, wherein said transient operating condition of said engine is an operating condition occurring immediately after said engine has left an idling condition.

3. An evaporative fuel control system as claimed in claim 2, wherein said second calculating means calculates said second learned value, based on said air-fuel ratio correction coefficient, when said air-fuel ratio feedback control is being executed and at the same time said engine is in said operating condition occurring immediately after said engine has left said idling condition.

4. An evaporative fuel control system as claimed in claim 1, wherein said learned value-setting means sets said first learned value to said second learned value when said second learned value is smaller than said first learned value.

5. In an evaporative fuel control system for an internal combustion engine having an intake system, a throttle valve arranged in said intake system, and a fuel tank, including a canister for adsorbing evaporative fuel generated in said fuel tank, a purging passage extending between said canister and said intake system, for purging evaporative fuel into said intake system at a location downstream of said throttle valve, a purge control valve for controlling a flow rate of said evaporative fuel to be purged into said intake system through said purging passage, air-fuel ratio correction coefficient-setting means for setting an air-fuel ratio correction coefficient applied in feedback control of an air-fuel ratio of an air-fuel mixture supplied to said intake system, based on concentration of a specific component in exhaust gases emitted from said engine, average value-calculating means for calculating an average value of said air-fuel ratio correction coefficient during execution of said air-fuel ratio feedback control, learned value-calculating means for calculating a learned value of said air-fuel ratio correction coefficient, based on said average value calculated by said average value-calculating means, and control means for controlling said purge control valve such that said flow rate of said evaporative fuel to be purged into said intake system is changed according to said learned value calculated by said learned value-calculating means, the improvement comprising:

changing means for changing said learned value calculated by said learned value-calculating means, based on a difference between said average value calculated by said average value-calculating means and said learned value calculated by said learned value-calculating means.

6. An evaporative fuel control system as claimed in claim 5, wherein said changing means changes said learned value by using an updating value, said updating value being set to a larger value as said difference between said average value calculated by said average value-calculating means and said learned value calculated by said learned value-calculating means increases.

7. In an evaporative fuel control system for em internal combustion engine having an intake system, a throttle valve arranged in said intake system, and a fuel tank, including a canister for adsorbing evaporative fuel generated in said fuel tank, a purring passage extending between said canister and said intake system, for purging evaporative fuel into said intake system at a location downstream of said throttle valve, a purge control valve for controlling a flow rate of said evaporative fuel to be purged into said intake system through said purging passage, air-fuel ratio correction coefficient-setting means for setting an air-fuel ratio correction coefficient applied in feedback control of an air-fuel ratio of an air-fuel mixture supplied to said intake system, based on concentration of a specific component in exhaust gases emitted from said engine, average value-calculating means for calculating an average value of said air-fuel ratio correction coefficient during execution of said air-fuel ratio feedback control, first learned value-calculating means for calculating a first learned value of said air-fuel ratio correction coefficient, based on said average value calculated by said average value-calculating means, and control means for controlling said purge control valve such that said flow rate of said evaporative fuel to be purged into said intake system is changed according to said first learned value calculated by said first learned value-calculating means, the improvement comprising:

transient operating condition-determining means for determining whether said engine is in a transient operating condition;

second learned value-calculating means for calculating a second learned value of said air-fuel ratio correction coefficient suitable for said transient operating condition of said engine;

learned value-setting means operable when said transient operating condition-determining means determines that said engine is in said transient operating condition, for setting said first learned value to said second learned value calculated by said second learned value-calculating means; and changing means for changing said first learned value calculated by said first learned value-calculating means, based on a difference between said average value calculated by said average value-calculating means and said first learned value calculated by said first learned value-calculating means.

* * * * *

UNITED STATES PATENT AND TRADEMARK OFFICE

CERTIFICATE OF CORRECTION

PATENT NO. : 5,778,865

DATED : 14 Jul 1998

INVENTOR(S) : TACHIBANA et al

It is certified that error appears in the above-identified patent and that said Letters Patent is hereby corrected as shown below:

Title Page, Item [56] References Cited, under "U.S. PATENT DOCUMENTS",

| | | | | |
|---|---|---|---|---|
| insert | --5,676,118 | 10/1997 | Saito | 123/679 |
| | 4,907,558 | 3/1990 | Manaka et al | 123/489 |
| | 4,416,237 | 11/1983 | Aoki et al | 123/438 |
| | 4,953/513 | 9/1990 | Sasaki et al | 123/489 |
| | 5,427,082 | 6/1995 | Thomas et al | 123/675--. |

Signed and Sealed this

Sixteenth Day of November, 1999

*Attest:*

Q. TODD DICKINSON

*Attesting Officer*

*Acting Commissioner of Patents and Trademarks*